United States Patent [19]

Meyer

[11] Patent Number: 4,810,552

[45] Date of Patent: Mar. 7, 1989

[54] TENSION CHORD MADE OF HYDRAULICALLY SETTING MASSES

[75] Inventor: Adolf Meyer, Leimen-Lingental, Fed. Rep. of Germany

[73] Assignee: Heidelberger Zement AG, Heidelberg, Fed. Rep. of Germany

[21] Appl. No.: 943,558

[22] Filed: Dec. 18, 1986

Related U.S. Application Data

[63] Continuation-in-part of Ser. No. 658,223, Oct. 5, 1984, abandoned.

[30] Foreign Application Priority Data

Oct. 13, 1983 [DE] Fed. Rep. of Germany ..... 3337268

[51] Int. Cl.[4] ..... B32B 5/12

[52] U.S. Cl. ..... 428/113; 106/99; 264/108; 428/105; 428/114; 428/293; 428/294; 428/297; 428/298; 428/323; 428/325; 428/326; 428/327; 428/704

[58] Field of Search ..... 428/703, 326, 327, 323, 428/325, 54, 182, 105, 113, 114, 292, 293, 294, 297, 298; 106/99; 264/108

[56] References Cited

U.S. PATENT DOCUMENTS

| | | | |
|---|---|---|---|
| 3,284,980 | 11/1966 | Dinkel | 52/600 |
| 4,062,913 | 12/1977 | Miller et al. | 264/108 |
| 4,127,636 | 11/1978 | Flanders | 428/326 |
| 4,379,870 | 4/1983 | Matsumoto | 106/99 |
| 4,472,473 | 9/1984 | Davis et al. | 428/182 |
| 4,483,727 | 11/1984 | Eickman et al. | 106/99 |
| 4,560,411 | 12/1985 | Melchior | 106/99 |
| 4,617,219 | 10/1986 | Schupack | 428/703 |

FOREIGN PATENT DOCUMENTS

| | | | |
|---|---|---|---|
| 0169022 | 1/1986 | European Pat. Off. | 428/703 |
| 0019326 | 2/1978 | Japan | 428/703 |
| 0014727 | 2/1978 | Japan | 428/703 |
| 0041916 | 4/1979 | Japan | 428/703 |
| 2071635 | 9/1981 | United Kingdom | 106/99 |

*Primary Examiner*—George F. Lesmes
*Assistant Examiner*—J. B. Monroe
*Attorney, Agent, or Firm*—Kurt Kelman

[57] ABSTRACT

A tension chord designed to be subjected to tensile forces in a predetermined direction made of a highly extensible hydraulically setting mass of low shrinkage and continuous, unidirectionally arranged fiber bundles is described.

15 Claims, 2 Drawing Sheets

TENSION CHORD MADE OF HYDRAULICALLY SETTING MASSES

Figure 1:
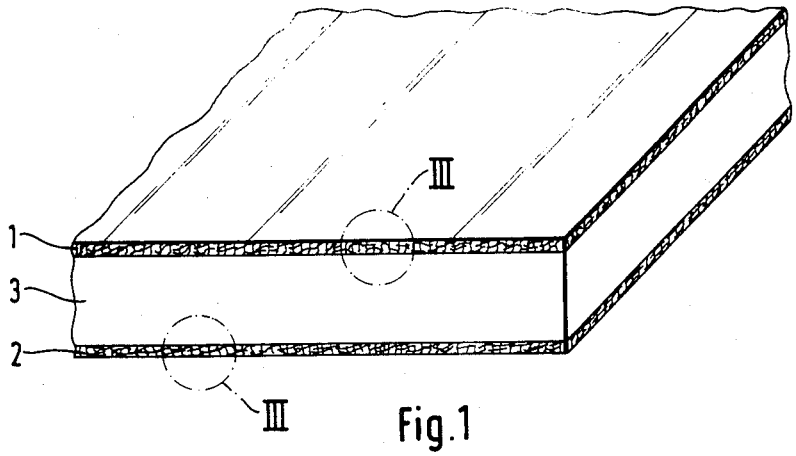

This is a continuation-in-part of my application Ser. No. 658,223, filed Oct. 5, 1984, now abandoned.

The invention relates to a tension chord or tension member made of highly extensible hydraulically setting masses and continuous unidirectionally arranged fiber bundles.

Elements made of hydraulically setting masses and reinforced by short fibers are widely known, e.g. in the form of asbestos-cement sheets or fibrous-concrete sheets, and valued because of their good properties. In order to achieve sufficient bearing capacity, these elements, which are subjected to bending load, need a relatively large quantity of short fibers as a result of the fact that the fibers are random-oriented and the short fibers must overlap. Furthermore, it is a familiar technique to reinforce elements made of hydraulically setting masses with continuous two-dimensional woven fabric, fiber meshes or mats made of fiber bundles embedded in plastics. When embedding the fiber bundles in plastics, in particular in synthetic resin, fiber-reinforced plastic rods are the result. In these tension rods, the transmission of forces from the hydraulically setting mass into the fiber is effected not directly but via the plastics. Their embedding in plastics protects the fiber bundles and facilitates the further processing to two-dimensional reinforcing elements such as woven fabric, fiber meshes and mats. Such two-dimensional reinforcing elements with openings in the range between 3 and 10 mm can be built relatively easily into hydraulically setting masses, the cross points of the fiber bundles improving the anchoring in the hydraulically setting mass. Here, it is disadvantageous that the embedding in plastics entails high costs and that the plastics are combustible. Furthermore, the critical bond length is increased. The mechanical properties of structural members reinforced in such a way are temperature-sensitive, and the deformations due to creep and temperature are considerable.

It has already been proposed to adjust the fiber reinforcement of a concrete structural element under load to the stress distribution and to reinforce individual zones of the structural element with short fibers or fiber bundles, the latter being arranged unidirectionally in the tension zone of the structural element and designed to take up the occurring tensile forces. Since the hydraulically setting and nonreinforced concrete is only slightly extensible under tensile stress (strain to failure 0.2 per mil), opening cracks occur at an early stage of loading. These wide cracks allow only a partial utilization of the tensile strength of the fiber bundles and impair the durability.

The object of the invention is to provide a tension chord made of hydraulically setting masses wherein the tensile strength of the continuous and undirectionally arranged fiber bundles can be fully utilized. This object is achieved by embedding the continuous unidirectionally arranged bundles of 30 to 300 synthetic nonmetallic fibers (filaments) of a diameter of 5 to 50 micrometer in a highly extensible hydraulically bonded microconcrete consisting mainly of aggregate and reinforced with short fibers in order to get a large number of very small microcracks instead of few opening cracks. By the combination in accordance with the invention of a specific formulation of a highly extensible hydraulically setting microconcrete mass, which is reinforced with short fibers and of low shrinkage, and the continuous unidirectionally arranged fiber bundles embedded in it, which are directly connected to the hydraulically setting microconcrete mass by direct bonding action, i.e. without intermediate plastics layer, a maximum efficiency of the fiber bundles is achieved. The highly extensible hydraulically bonded microconcrete mass of the tension chord in accordance with the invention and the continuous fiber bundles embedded in the microconcrete mass and surrounded by it on all sides jointly take up the tensile forces until shortly before breaking load has been reached. By this, the tension chord in accordance with the invention can transmit considerably greater tensile forces than a tension chord made of a less extensible mass with the same fiber bundles. Only when overloaded, the strain to failure of the hydraulically bonded mass reinforced with short fibers will be reached. The continuous fibers alone then take over the transmission of the tensile forces.

Up till now, experts held the opinion that an incorporation of continuous fiber bundles in granular hydraulically bonded masses requires a previous embedding of the fiber bundles in plastics. It was assumed that—contrary to liquid synthetic resin—granular suspensions cannot enter the small interspaces of a fiber bundle in order to achieve a bond anchoring. Furthermore, a destruction of the very fine fibers of the fiber bundles through the granular mineral aggregate was feared. In addition, the tensile strength of the fiber bundles in a hydraulically bonded mass could only be partly utilized up til now, since wide opening cracks occur in the only slightly extensible mass.

I have found, revealed that it is possible to incorporate fiber bundles in specific granular hydraulically bonded microconcrete masses without embedding the fiber bundles in plastics and that a perfect direct bonding action between the fibers and the hydraulically setting microconcrete mass can be achieved by hydration products of the hydraulically setting mass that grow on the fibers. By this, the critical bond length as compared with fiber bundles embedded in synthetic resin is shortened with a favorable effect. The tension chord in accordance with the invention has no disadvantages with respect to the embedding of the fiber bundles in plastics.

The fiber bundles of the tension chord in accordance with the invention only need a cover in the millimeter range. Reinforcing steel, on the other hand, needs a cover of 1 to 3 cm for corrosion protection reasons. The larger effective depth of the structural member with a tension chord in accordance with the invention has a positive effect on the bearing capacity therefore.

Another important advantage of the tension chord in accordance with the invention is the fact that significantly fewer fibers are needed as reinforcement as compared to conventional fibrous concrete with short fibers. For standard sheets reinforced with short fibers, e.g., 5 percent volume of fibers is required. Sheets with tension chords in accordance with the invention, however, need only approximately 2 to 3 volume percent of fibers in order to achieve an equal bearing capacity and impact strength. As compared to asbestos cement with more than 10% asbestos fibers, the savings are even more striking.

While the strain to failure of conventional concrete is approx. 0.2 per mil, the strain to failure of the highly extensible mass used in accordance with the invention is at least 2 per mil, usually more than 5 per mil. The mass used in accordance with the invention is highly extensible, above all due to the contents of short fibers contained in it. In addition, the extensibility can be increased by the addition of polymers. Under load, the highly extensible mass and the fiber bundles embedded in it extend without the occurrence of wide opening cracks. The unavoidable uniformly distributed very fine microcracks occurring under design load have no negative effect either on bonding or on durability.

The weight percentage of aggregate in the mass if preferably higher than the weight percentage of hydraulic binders, in particular cement. The mass according to the invention is microconcrete and not cement paste without or with some amount of filler.

The aggregate consists of fine mineral particles with a favorable grading and a max. particle size of 4 mm. Shrinkage is reduced by the high percentage of aggregate in the microconcrete mass. While conventional hydraulically setting masses for fiber-reinforced products have a drying shrinkage of approx. 3 mm/m, the mircoconcrete used in accordance with the invention is mostly set to a drying shrinkage of approx. 1 mm/m. Only a minimal portion of short fibers is needed for taking up residual shrinkage stresses. The low shrinkage also has a positive effect on the interaction between the fiber bundles and the highly extensible hydraulically bonded microconcrete mass when subjected to tensile stress. Furthermore, the high contents of aggregate in the microconcrete mass used in accordance with the invention results in a high modulus of elasticity, high stiffness, low thermal expansions, high abrasion resistance, reduced alkalinity and low costs. This is possible as a result of the fact that the water requirements is considerably reduced by high-range water reducing agents, e.g. on the basis of melamine or naphtalene.

In a preferred further embodiment, the hydraulically setting microconcrete mass of the tension chord in accordance with the invention contains only little or no calcium hydroxide, i.e. it has only a low alkalinity and a low pH-value, in order to improve the durability, in particular when using glass fibers.

A low calcium hydroxide content in the microconcrete mass can be achieved, for example, by using a hydraulic binder, which produces little or no calcuim hydroxide in hydration. The CGC cement produced by Chichibu Cement Company Ltd., Tokyo/Japan, which consists mainly of calcium silicate, calcium aluminate sulfate, anhydrite and water-quenched granular blast-furnace slag, fulfills this requirement. The alkalinity of the microcement can be further reduced by replacing parts of cement or aggregate by material reacting with calcium hydroxide.

However, it is also possible to reduce the alkalinity of the mass after setting by carbonization.

The short fibers can be glass fibers, plastic fibers, carbon fibers or natural fibers. In particular, alkaline-resistant glass fibers are suitable.

The fiber bundles, which are arranged continuously over the full length of the structural member without transverse reinforcement in order to improve the bond, can densely lay in one common plane. In this way, they can be utilized especially effectively. However, it is also possible to arrange the fiber bundles in two or more superposed layers and to fix them in their desired position by measures such as spacers or supports in the form of woven fabric, fiber meshes or mats with great openings as well as larger particles of aggregate. The fiber bundles of the individual layers are preferably arranged in parallel. However, they can also be arranged at angles to each other, preferably forming small angles.

The fibers of the fiber bundles can be glass fibers, plastic fibers or carbon fibers, alkaline-resistance textile glass fibers being preferred. When a mass with low alkalinity as mentioned above is used, however, the use of normal glass fibers can also be taken into consideration. The fiber bundles of the tension chord in accordance with the invention are preferably saturated with a liquid, especially aqueous medium in order to prevent a change in the consistency of the mass by sucking off water and in order to ensure a perfect bonding action between fibers and microconcrete mass.

By means of tension chords or tension members in accordance with the invention, extremely cost-effective, durable elements with high impact and tensile strength made of hydraulically setting masses can be produced. In the case of elements subjected to bending load, the tension chord in accordance with the invention is the element's surface zone subjected to tensile stress. In the case of a 10 mm thick flat sheet, for example, the tension chord may be 1–2 mm thick. When arranged on both sides, the sheet has the static action of a sandwich construction, the core only having the function of transmitting shear forces. In the case of corrugated sheets, trapezoidal sheets and other sheets with profiled cross-sections, on the other hand, the outer strip-shaped parts are tension chords, the thickness of the sheet equalling the thickness of the tension chord. Flat elements like flat sheets as well as profiled elements with tension chords in accordance with the invention can be formed prior to hardening to make different elements such as pipes, shells, bowls, channels or any other three-dimensional elements.

Examples of embodiments of elements with tension chords in accordance with the invention are shown in the accompanying drawings wherein FIG. 1 shows a flat sheet with the tension chords 1 and 2 arranged in the two surface zones, which are connected to each other by means of the solid core 3.

Figure 2:
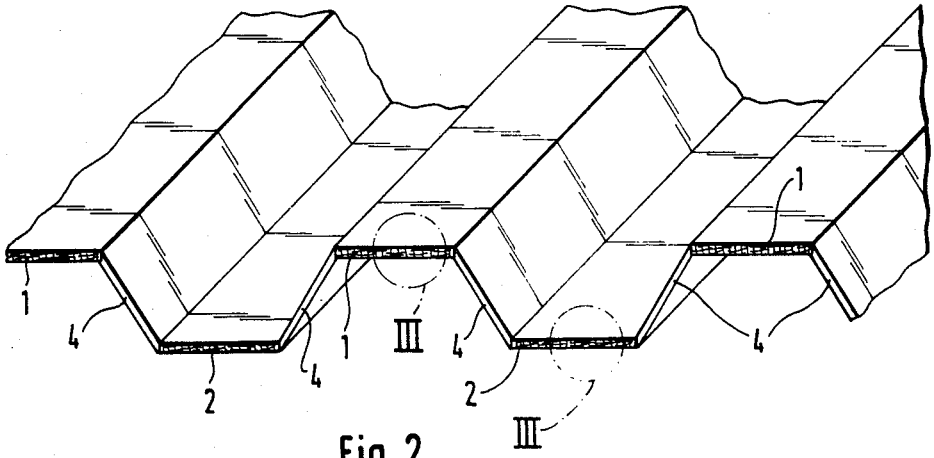

FIG. 2 shows a trapezoidal sheet. The tension chords 1 and 2 are connected to each other by the ribs 4 which transmit the shear forces.

Figure 3:
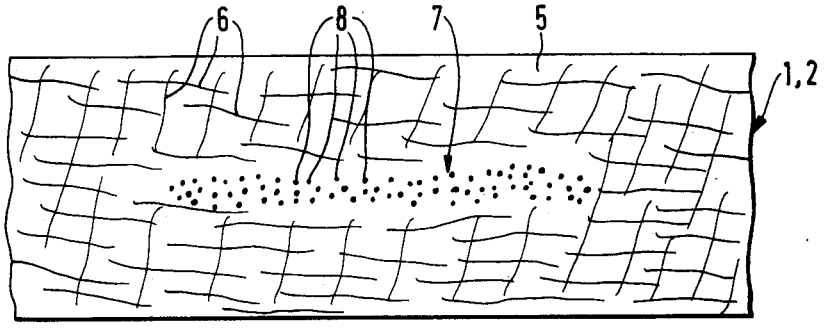

FIG. 3 schematically shows the enlarged partial view III of a tension chord as marked in FIGS. 1 and 2. The highly extensible hydraulically bonded mass 5 is reinforced with short fibers 6. The fiber bundle 7 consists of a number of fibers (filaments) 8 and is surrounded by the mass on all sides.

Figure 4:
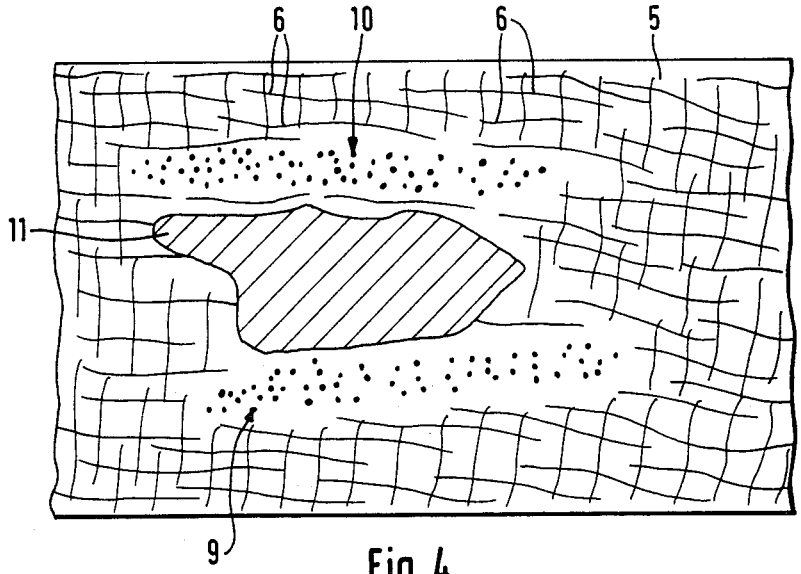

FIG. 4 shows a tensile chord with two superposed fiber bundles 9 and 10, which are fixed in their position by the spacer 11.

The tension chord can be used for elements made of hydraulically setting masses of any shape. The drawings show only a few examples.

I claim:

1. A tension chord designed to be subjected to tensile forces extending in a predetermined direction, which essentially comprises (a) a highly extensible hydraulically setting microconcrete reinforced with short randomly-oriented fibers, the microconcrete having a strain to failure of more than 2 per mil and a drying shrinkage of about 1 mm/m, and essentially consisting of (1) aggregate forming a main portion of the microconcrete and (2) a hydraulic binder, the aggregate being a material inert to the hydraulic binder during the hydraulic setting of the microconcrete, and (b) continuous, unidirectionally arranged fiber bundles extending in said predetermined direction, each fiber bundle consisting of 30 to 300 alkali-resistant textile glass filaments embedded in the microconcrete, surrounded by it on all sides, and bonded thereto by direct bonding action.

2. The tension chord of claim 1, wherein the highly extensible microconcrete further comprises a polymer additive enhancing the extensibility of the microconcrete.

3. The tension chord of claim 1, wherein the aggregate exceeds the hydraulic binder in weight, and the microconcrete further comprises a high-range water reducing agent whereby the water requirement of the microconcrete is reduced.

4. The tension chord of claim 1, wherein the aggregate consists of fine mineral particles having a maximum size of less than 4 mm.

5. The tension chord of claim 1, wherein the microconcrete is low in alkalinity.

6. The tension chord of claim 1, wherein the short fibers are selected from the group consisting of glass fibers, synthetic resin fibers, carbon fibers and natural organic fibers.

7. The tension chord of claim 1, wherein the fiber bundles are arranged continuously over the full length of the tension chord and without transverse connection therebetween.

8. The tension chord of claim 1, wherein the fiber bundles are closely packed in a common plane.

9. The tension chord of claim 1, wherein the fiber bundles are arranged in a plurality of superposed planes.

10. The tension chord of claim 1, further comprising spacers or supports between the fiber handles for fixing the fiber bundles in desired positions.

11. The tension chord of claim 1, wherein the fiber bundles are arranged substantially parallel to each other.

12. The tension chord of claim 1, wherein the fiber bundles are arranged at an angle to each other.

13. The tension chord of claim 1, wherein the fiber bundles are saturated with an aqueous liquid prior to embedding them in the microconcrete.

14. A structure element subjected to tensile stress under a bending load so as to result in tensile forces extending in a predetermined direction, consisting of two opposing surfaces each formed of a tension cord and connected to each other by a solid core, each tension cord comprising (a) a highly extensible hydraulically setting microconcrete reinforced with short randomly-oriented fibers, the mircoconcrete having a strain to failure of more than 2 per mil and a drying shrinkage of about 1 mm/m, and essentially consisting of (1) aggregate forming a main portion of the microconcrete and (2) a hydraulic binder, the aggregate being a material inert to the hydraulic binder during the hydraulic setting of the microconcrete, and (b) continuous, unidirectionally arranged fiber bundles extending in said predetermined direction, each fiber bundle consisting of 30 to 300 alkali-resistant textile glass filaments embedded in the microconcrete, surrounded by it on all sides and bonded thereto by direct bonding action.

15. A structural element of profiled cross-section subjected to tensile stress under a bending load so as to result in tensile forces extending in a predetermined direction and having strip-shaped parts thereof formed of tension cords, each tension cord comprising (a) a highly extensible hydraulically setting microconcrete reinforced with short randomly-oriented fibers, the microconcrete having a strain to failure of more than 2 per mil and a drying shrinkage of about 1 mm/m, and essentially consisting of (1) aggregate forming a main portion of the microconcrete and (2) a hydraulic binder, the aggregate being a material inert to the hydraulic binder during the hydraulic setting of the microconcrete, and (b) continuous, unidirectionally arranged fiber bundles extending in said predetermined direction, each fiber bundle consisting of 30 to 300 alkali-reisitant textile glass filaments embedded in the microconcrete, surrounded by it on all sides and bonded thereto by direct bonding action.

* * * * *